US006929776B1

(12) United States Patent
Loh

(10) Patent No.: US 6,929,776 B1
(45) Date of Patent: Aug. 16, 2005

(54) JEWELRY ALLOY COMPOSITIONS

(75) Inventor: Peng Chum Loh, Singapore (SG)

(73) Assignee: Innomart PTE Ltd., Singapore (SG)

( * ) Notice: Subject to any disclaimer, the term of this patent is extended or adjusted under 35 U.S.C. 154(b) by 0 days.

(21) Appl. No.: 09/890,548

(22) PCT Filed: Jan. 31, 2000

(86) PCT No.: PCT/SG00/00013

§ 371 (c)(1),
(2), (4) Date: Jan. 9, 2002

(87) PCT Pub. No.: WO00/46413

PCT Pub. Date: Aug. 10, 2000

(30) Foreign Application Priority Data

Feb. 2, 1999 (SG) ..... 9900056

(51) Int. Cl.[7] ..... C22C 5/02
(52) U.S. Cl. ..... 420/507; 148/430
(58) Field of Search ..... 420/507

(56) References Cited

FOREIGN PATENT DOCUMENTS

| | | | |
|---|---|---|---|
| JP | 203342 | | 5/1982 |
| JP | 62240729 A | * | 5/1984 |
| JP | 083026 | | 10/1987 |
| JP | 59093847 A | * | 10/1987 |
| JP | 085076 | | 3/1998 |

OTHER PUBLICATIONS

Cahn, Robert W. "A precious stone that isn't", Nature, vol. 396, Dec. 1998, pp. 523–524.*
Cretu, Cristian and van der Lingen, Elma, "Coloured Gold Alloys", Gold Technology, vol. 30, Winter 2000, pp. 31–40.*
"Precious Metals", edited by Benner et al, pub. by The International Precious Metals Institute, 1991, pp. 443–447.*
English abstract of JP 59–093847 A (Takiguchi).*
English abstract of JP 62–240729 A (Miyama).*
International Search Report PCT/SG00/00013 AU—Apr. 18, 2000.

* cited by examiner

*Primary Examiner*—Roy King
*Assistant Examiner*—Harry D. Wilkins, III
(74) *Attorney, Agent, or Firm*—Harness, Dickey & Pierce, P.L.C.; Linda M. Deschere

(57) ABSTRACT

A jewellery alloy, having a substantially purple hue and sufficient toughness to withstand Rockwell 3 hardness testing with a 100 kg load without shattering, comprises 76 to 83.5 wt % gold and 16.5 to 21.5 wt % aluminum. In one embodiment, the alloy consists of more than 78.5 wt % gold (but not more than 83.5 wt %) and a balance or aluminium. In another embodiment, the alloy comprises an additional element selected from palladium and nickel.

7 Claims, No Drawings

JEWELRY ALLOY COMPOSITIONS

The present invention relates to novel jewellery alloy compositions.

Aluminium—gold alloys, with the comparable atomic size factors (2.878:2.8577), similar lattice crystal structure (f.c.c.) and large variation in electro-negativity factor, produce adversity of microstructures and phases. The aluminium-gold phase diagram illustrates regions of solid solution, eutectic, and complex compound ($Au_5Al_3$ $AuAl_2$, gamma, etc). The $AuAl_2$ intermetallic compound is a complex cubic structure similar to 1 manganese and is a somewhat metastable state, with an electron: atom ratio of 3:2 and a weight percent ratio of 78.5% Au:21.5% Al. It is of particular interest to jewellers and the like because of its brilliant purple-golden colour. However, interest is largely offset by the fact that the $AuAl_2$ intermetallic compound is very brittle; like ordinary glass or porcelain it will fracture with a hard knock. In fact, its brittleness is such that the $AuAl_2$ intermetallic compound cannot be hardness tested using the Rockwell B hardness testing machine with a 100 kg load; it will fracture even when a 60 kg load is applied.

According to the teachings of Japanese patent application JP 61-30642 in the name Tokuriki Honten Pte Ltd, one way of overcoming the brittleness problem is to lower the gold component to 75 wt % whilst employing aluminium in an amount 20 to 24.5 wt %, and at the same time introducing 0.5 to 5 wt % of one or two additional elements selected from the group consisting of silicon, magnesium, copper, zinc or manganese. By varying the relative amount of the additional element(s), the tone or hue of the colour may be changed subtly without losing the basic purple colour.

As can be seen from the Au—Al phase diagram, lowering the gold content below 78.5 wt % in the AuAl system gives rise to the co-existence of two structures—the $AuAl_2$ intermetallic compound and the eutectic structure of Al and $AuAl_3$— in the same sample. Thus, upon slow cooling from the molten phase or annealing of rapidly solidified samples, precipitation of the aluminium rich eutectic phase on outward surfaces degrades the purple-golden colour. Even if rapidly solidified samples are not annealed, similar decolouration of the purple-gold colour may also occur after fabricating and polishing the jewellery and possibly even through prolonged usage, albeit at a much slower rate. The hardness of the eutectic and $AuAl_2$ phase is also significantly lower (around 10% for an alloy of 75 wt % gold and 25 wt % aluminium) than that of the $AuAl_2$ intermetallic compound. For these two reasons, the commercial viability of the alloy is limited.

It is an object of the present invention to provide a novel jewellery alloy which for the purposes of the present specification is defined as having sufficient toughness to withstand Rockwell B hardness testing with a 100 kg load without shattering. Being able to use Rockwell B hardness testing is perceived as an empirical measure that the alloy is suitable for fabricating jewellery; if the alloy is too brittle to withstand Rockwell B hardness testing, it is too brittle to be used in jewellery. The term "jewellery" is intended to cover ornamental objects for personal adornment or otherwise, including medallions, and the like (eg coins) where the stated toughness is a prerequisite.

In accordance with a first aspect of the present invention there is provided a jewellery alloy as hereinbefore defined, comprising 76–83.5 wt % gold and 16.5–21.5 wt % aluminium, and having a substantially purple hue (at least on annealing at 600° C.).

By definition, the jewellery alloy does not include pure intermetallic compound $AuAl_2$ (78.5 wt % Au and 21.5 wt % Al) because it does not have the toughness to withstand Rockwell B hardness testing with a 100 kg load. The term 'substantially purple hue' includes the colours reddish or pinkish purple and lighter purples.

Preferably, the hardness of the jewellery alloy remains substantially similar to that of the $AuAl_2$ intermetallic compound; that is to say, the hardness of the jewellery alloy is within about 6%, more preferably 5%, of the hardness of $AuAl_2$.

In one embodiment, the gold content may be above 78.5 wt % up to a maximum of 83.5 wt %, with the balance being aluminium. In this way, the requisite toughness is achieved by producing a gamma-phase gold aluminium structure.

In another embodiment, the jewellery alloy may have a gold content of less than 78.5 wt % and further comprise an additional element selected from the group consisting of palladium and nickel. The aluminium content may preferably be 18.5–19.5 wt %. The gold/aluminium ratio is preferably higher than 3.66. In preferred alloys, the amount of palladium when used as the additional element is in the range 0.5 wt % to 4.0 wt %; the amount of nickel when used as the additional element is in the range 1.0 wt % to 2.0 wt %.

There is also provided an article comprising a metal component, wherein the metal component is fabricated from a jewellery alloy in accordance with the present invention.

In accordance with a second aspect of the present invention, there is provided a jewellery alloy containing 16.5–21.5 wt % aluminium, 0–4.0 wt % palladium, 0–2 wt % nickel and balance gold (except for impurities and incidental elements). The jewellery alloy may optionally contain small or trace amounts of elements, (eg oxygen) either constituting incidental constituents added in accordance with established practice or present as impurities. In one embodiment, the jewellery alloy may be a binary alloy containing at least 16.5 wt % up to (but not including) 21.5% aluminium, and balance gold. In a second embodiment, the jewellery alloy may contain 0.5–4.0 wt % palladium, with nickel substantially absent. In a third embodiment, the jewellery alloy may contain 1.0–2.0 wt % nickel, with palladium substantially absent. In all embodiments, the gold/aluminium ratio should be higher than 3.66. In the second and third embodiments, the aluminum content is preferably 16.5–19.5 wt %.

According to a third aspect of the present invention, there is provided an alloy containing 18.5–19.5 wt % aluminium, 0.5–4.0 wt % palladium and balance gold. According to a fourth aspect of the present invention, there is provided an alloy containing 18.5–19.5 wt % aluminium, 1.0–2.0 wt % nickel and balance gold.

A better understanding of the present invention may be obtained in the light of the following examples embodying the invention which are set forth to illustrate, but are not to be construed as limiting, the present invention.

Six example alloys embodying the present invention and two control alloys were manufactured and tested as follows:

1. All specimens were tested using a Rockwell B hardness testing machine with a 100 kg load. Where it was apparent that a specimen lacked sufficient toughness to withstand the Rockwell B hardness test, micro hardness testing with a 200 g load was first conducted followed by an annealing and subsequent Rockwell B hardness testing.

ii) All specimens were annealed at 600° C. and examined for precipitation of low melting point aluminium-rich eutectic. Such precipitation would be evident from the appearance of a greyish-white colour between reddish-purple regions on the specimen surface.

Control 1 (78.5 wt % Au and 21.5 wt % Al).

The $AuAl_2$ intermetallic compound has a brilliant purple hue, but is known to be brittle. The micro-hardness testing with a 200 g load gave a reading of Vickers 250 (HRB-102 by conversion). After annealing no visible precipitates were found. Subsequent testing with Rockwell B hardness machine resulted in multiple fracturing of the specimen.

Control 2 (75 wt % Au and 25 wt % Al)

The specimen has a reddish-purple colour, but was much softer than control 1 having a HRB of 91. Subsequent annealing resulted in large amounts of Al-rich eutectic precipitation which seriously degrades the surface reddish-purple colour.

EXAMPLE 1

(80.5 wt % Au and 19.5 wt % Al)

In comparison with control 1, the specimen was slightly softer (HRS of 101), but much tougher as demonstrated by the fact that the sample survived Rockwell B hardness testing. Subsequent annealing showed no sign of precipitation and grain structure colour was pinkish-purple.

EXAMPLE 2

(81 wt % Au and 19 wt % Al)

In comparison with control 1, the specimen was softer (HRB of 96), but much tougher as demonstrated by withstanding a Rockwell B hardness test. Subsequent annealing showed no sign of precipitates and the grain structure colour was pinkish-purple.

EXAMPLE 3

(79.7 wt % Au, 19.3 wt % Al and 1 wt % Pd)

In comparison with control 1, the specimen was slightly harder (HRB of 103), but much tougher as demonstrated by withstanding a Rockwell B hardness test. Subsequent annealing showed no sign of precipitation and the grain structure was pinkish-purple.

EXAMPLE 4

(79.7 wt % Au, 19.3 wt % Al and 1.0 wt % Ni)

In comparison to control l, the specimen was softer (HRB of 97.5), but much tougher as demonstrated by withstanding a Rockwell B hardness test. Subsequent annealing showed no sign of precipitates, and the grain structure colour was pinkish purple.

EXAMPLE 5

(79.4 wt %, 18.6 wt % Al and 2.0 wt % Pd)

In comparison with control 1, the specimen was softer (HRB of 97), but much tougher as demonstrated by withstanding a Rockwell B hardness test. Subsequent annealing showed no sign of precipitation, and the grain structure colour was pinkish purple.

EXAMPLE 6

(77 wt % Au, 20 wt % Al and 3 wt % Pd)

In comparison with control 1, the specimen was slightly harder (HRB of 104.8), but much tougher as demonstrated by withstanding the Rockwell B hardness test. Subsequent annealing showed no signs of precipitates and the grain structure colour was pinkish purple.

The foregoing examples demonstrate that it is possible to make a tough purple gold-rich alloy by transforming the fragile or brittle $Au_3Al$ intermetallic compound into the tougher gamma phase structure by either increasing the gold content above 78.5 wt % (75% molar content) or by alloying with additional element(s).

What is claimed is:

1. A jewelry alloy formed from a molten phase and consisting of 76–83.5 wt % gold and 16.5–21.5 wt % aluminum and an additional element selected from the group consisting of palladium and nickel; provided that when said palladium is present, it is present in an amount by weight of up to 4%; and provided that when said nickel is present, it is present in an amount by weight of up to 2%.

2. A jewelry alloy according to claim 1, in which the aluminum content is 18.5–19.5 wt %.

3. A jewelry alloy according to claim 1, wherein the additional element is palladium and is present in an amount of between 0.5 wt % and 4.0 wt %.

4. A jewelry alloy according to claim 1, wherein the additional element is nickel and is present in an amount of between 1.0 wt % and 2.0 wt %.

5. An alloy formed from a molten phase and comprising 16.5–21.5 wt % aluminum, 0–4.0 wt % palladium, 0–2 wt % nickel and the balance gold, provided that one of said palladium and nickel is present.

6. The alloy of claim 5, containing 18.5–19.5 wt % aluminum, 0.5–4.0 wt % palladium and the balance gold, except for impurities and incidental elements.

7. The alloy of claim 5, containing 18.5–19.5 wt % aluminum, 1.0–2.0 wt % nickel and the balance gold, except for impurities and incidental elements.

* * * * *